United States Patent [19]

Gillispie

[11] Patent Number: 4,662,544

[45] Date of Patent: May 5, 1987

[54] APPARATUS FOR DISPENSING FLUID

[75] Inventor: John G. Gillispie, Wellsburg, W. Va.

[73] Assignee: Eagle Manufacturing Company, Wellsburg, W. Va.

[21] Appl. No.: 753,773

[22] Filed: Jul. 11, 1985

[51] Int. Cl.[4] ..... B67D 5/40

[52] U.S. Cl. ..... 222/385; 137/846

[58] Field of Search ..... 222/336, 385, 324, 383, 222/381; 417/545, 550, 552; 137/843, 844, 846, 845; 251/347, 341, 353

[56] References Cited

U.S. PATENT DOCUMENTS

| | | | |
|---|---|---|---|
| 1,862,083 | 7/1932 | Hagstrom | 222/324 |
| 1,865,990 | 7/1932 | Wilcox | 222/324 |
| 1,915,343 | 6/1933 | Williams | 222/321 |
| 2,048,142 | 7/1936 | Santurello | 221/80 |
| 2,061,476 | 11/1936 | Faull | 221/51 |
| 2,431,881 | 12/1947 | Miller | 220/39 |
| 2,473,696 | 6/1949 | Anderson | 222/385 |
| 2,595,118 | 4/1952 | Anderson | 222/381 |
| 2,693,899 | 11/1954 | Trout | 222/381 |
| 3,486,456 | 12/1969 | Hager et al. | 417/550 |
| 3,664,556 | 5/1972 | Perry et al. | 222/385 |
| 3,822,720 | 7/1974 | Souza | 137/846 |
| 4,458,711 | 7/1984 | Flider | 137/71 |
| 4,524,805 | 6/1985 | Hoffman | 137/846 |

*Primary Examiner*—Joseph J. Rolla
*Assistant Examiner*—Kenneth Noland
*Attorney, Agent, or Firm*—Parmelee, Miller, Welsh & Kratz

[57] ABSTRACT

Apparatus for dispensing fluids comprising a container, a cap for the container, a first cylinder integral with the cap having a portion within the container and a portion outside the container, a spout assembly attached to the latter portion of the first cylinder, a coaxial second cylinder disposed around the lower exterior portion of the first cylinder, reed valves coaxially disposed in the lower portions of each cylinder, and means to move the second cylinder upwardly relative to the first cylinder.

6 Claims, 5 Drawing Figures

APPARATUS FOR DISPENSING FLUID

FIELD OF THE INVENTION

This invention relates to apparatus for dispensing fluids of the type wherein by manipulation of a hand triggered mechanism the contents of a receptacle are ejected through a spout at will.

BACKGROUND OF THE INVENTION

There are many devices for dispensing fluids from a hand-held container suitable for the purpose for which they were made. Unfortunately, most of these devices are difficult to assemble and equally difficult to disassemble if one wishes to refill the container or if one desires to clean the same. Additionally, most of these devices are made of many components, thus further increasing the cost of making the same. Finally, these devices generally require the use of ball check valves, which do not always function as desired. Thus, they may lose their shape, or a coating may form thereon from the contents of the container, and their ability to function properly is severly impaired.

Fluid dispensing devices of many kinds are known. Thus, Hagstrom in U.S. Pat. No. 1,862,083, dated June 7, 1932, discloses a force feed oil can employing a piston and cylindrical element, in which a ball check valve is mounted, for forcing a quantity of oil therefrom when a lever mechanism is actuated. In U.S. Pat. No. 1,865,990 to Wilcox, dated July 5, 1932, there is disclosed an oil can containing a pumping mechanism comprising a barrel extending longitudinally therein, a ball check valve controlling flow through said barrel and an inlet tube depending from said barrel for driving oil into said barrel. Williams in U.S. Pat. No. 1,915,343, dated June 27, 1933, discloses an oil can having a pumping unit disposed therein wherein the stem or plunger thereof is tubular and reciprocates with the pump when actuated by the finger-operated lever. A number of ball check valves are employed. In U.S. Pat. No. 2,048,142, dated July 21, 1936, Santurello discloses a fluid dispensing device comprising a piston and cylinder mechanism using ball check valves disposed within the container operable by handle or gripping members disposed on the outside of the container. U.S. Pat. No. 2,061,476 to Paull, dated Nov. 17, 1936, discloses a hand oiler having an integral connection of a pumping mechanism and spout with a rocking trigger, using a ball check valve. Miller in U.S. Pat. No. 2,431,881, dated Dec. 2, 1947, discloses a unitary handle and screw top for an oil can. In U.S. Pat. No. 2,473,696 to Anderson, dated June 21, 1949, there is disclosed a hand oiler comprising a container, a cap therefor, a pump conduit assembly extending downwardly into the container and a complicated pump mechanism located within the container using a number of ball check valves. Perry et al. in U.S. Pat. No. 3,664,556, dated May 23, 1972, relate to a hand pump oiler comprising a fixed piston having a port therethrough connected to the oiler spout, and a movable cylinder, provided with a disc-shaped valve, that slides over the piston to pump oil through the spout. U.S. Pat. No. 4,458,711, to Flider, dated July 10, 1984 discloses the use of reed valves in a vent valve apparatus for venting fluid containers.

SUMMARY OF THE INVENTION

The present invention is directed to an apparatus for dispensing fluid comprising a container and a cap closure therefor having an opening therein. An elongated, vertically disposed first cylinder integral with the cap closure is provided having a first portion extending vertically downwardly into the container and a second portion extending vertically upwardly and exteriorly of the container. The second portion of the first cylinder is closed at the upper end but has an opening in a wall with a spout assembly mounted in the latter opening. An elongated, vertically disposed coaxial second cylinder is slidably disposed around the lower exterior portion of the first cylinder. A lug integral with the second cylinder is mounted on the outer wall thereof. An elongated vertical stem integral with the lug extends vertically upward therefrom through the opening in the cap closure and exteriorly of the cap closure. A compression spring is coiled around the elongated vertical stem and disposed between the lug and the underside of the cap closure. An elongated trigger mechanism is disposed on the cap closure having a first portion extending across the upper surface of said cap closure and is provided with a first opening, through which the elongated vertical stem passes upwardly therethrough, and a second opening through which the second portion of the first cylinder passes upwardly therethrough. The elongated stem has an enlarged head at the upper end thereof in abutting relationship with the upper surface of the first portion of the trigger mechanism. The trigger mechanism also has a second portion extending outwardly from the cap closure. A first cylindrical reed valve is coaxially disposed in the lower portion of the elongated first cylinder and a second reed valve is coaxially disposed in the lower portion of the elongated second cylinder. Each of the reed valves is open at one end and tapered on two sides thereof to its other end, thereby forming an orifice at said other end. The reed valves are disposed so that the orifices face upwardly.

DETAILED DESCRIPTION OF THE PREFERRED EMBODIMENT

Figure 1:
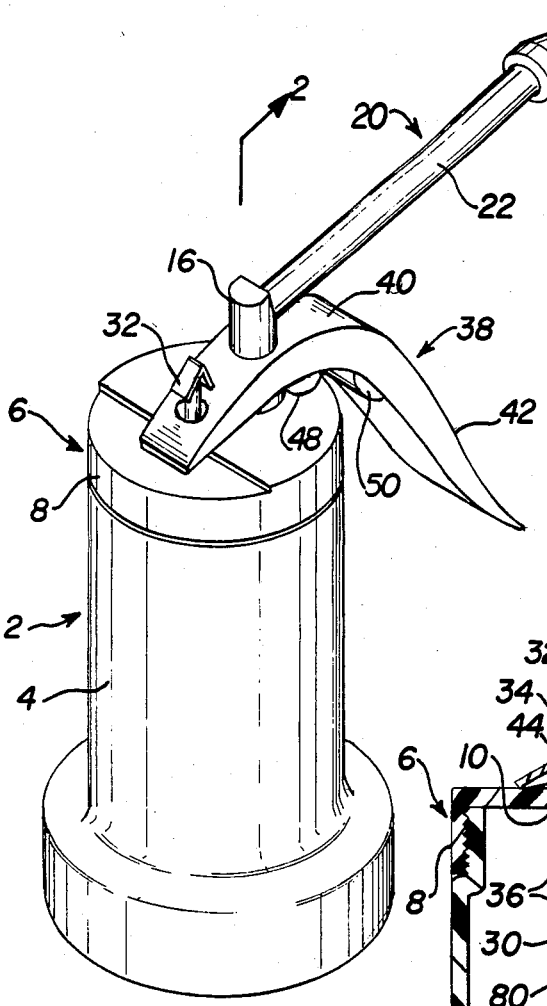
FIG. 1 is a perspective view of the novel apparatus for dispensing fluid claimed herein.
Figure 2:
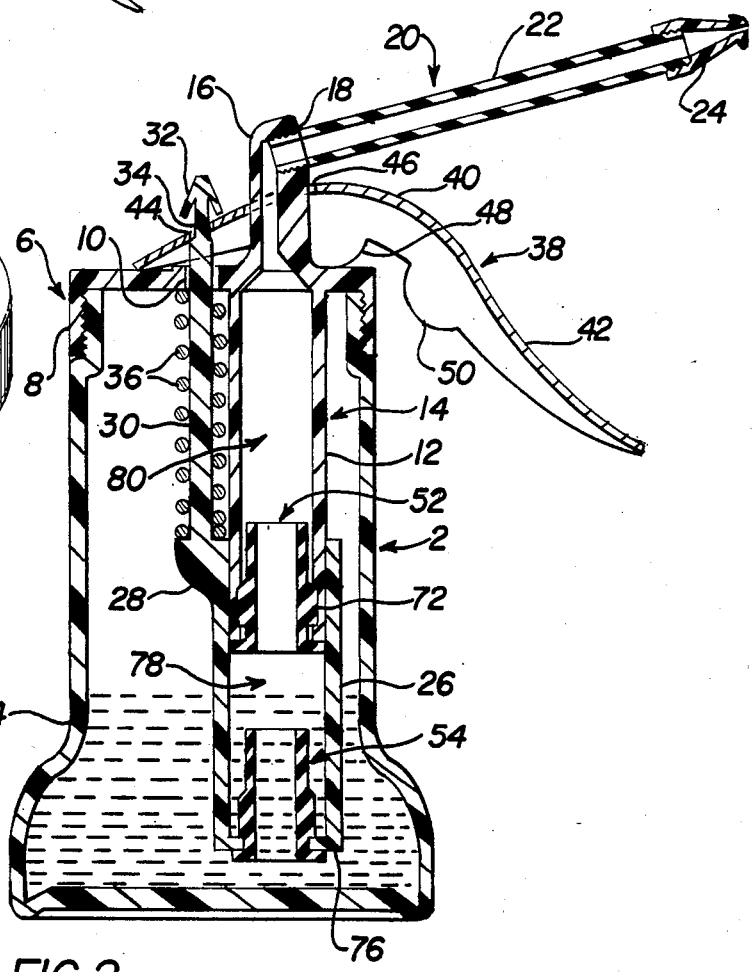
FIG. 2 is an elevational, cross-sectional view of the novel apparatus for dispensing fluid taken substantially along the line 2—2 shown in FIG. 1.

The novel apparatus 2 claimed herein for dispensing fluid can be described by reference to FIGS. 1 and 2. Numeral 4 defines a container, adapted to maintain therein a fluid that is to be dispensed therefrom, and 6 a cap closure therefor, preferably carrying a depending annular flange 8. Cap closure 6 is securely mounted onto container 4 in any suitable manner that will facilitate quick and easy mounting thereon or removal therefrom. Thus, for this purpose, cap closure 6 can be provided with threads corresponding to threads on on container 4 as shown in FIG. 2. Cap closure 6 is also provided in the horizontal portion thereof with an opening 10 through which an elongated, vertically disposed stem, described hereinafter, extends.

Cap closure 6 is provided with an elongated, vertically disposed first cylinder 12 integral with said cap closure having a first portion thereof 14 extending vertically downwardly into container 4 to a level intermediate the top and bottom of said container and a second portion thereof 16 extending vertically upwardly and exteriorly of said container 4. Said second portion 16 of said elongated, vertically disposed first cylinder 12 is closed at the upper end thereof but is provided with an opening 18 in a wall thereof wherein there is mounted, in any suitable manner, a spout assembly 20. Preferably, such mounting is done, as shown in FIG. 2, by providing one end of the spout assembly 20 with threads on the outer surface therof and, similarly, threads on the inner surface of said opening 18. In this way, the spout assembly can be easily and quickly screwed onto said second portion 16 of said first cylinder 12 or just as easily be removed therefrom. The spout assembly 20 is preferably composed of a tube 22, disposed horizontally, or at any suitable angle from the horizontal, and a spout, or nozzle 24 attached at the free end of the tube 22, using any suitable means. In the preferred embodiment, as shown in FIG. 2, the free end of tube 22 and spout 24 are provided with appropriate threading, so that spout 24 can be easily and quickly attached to, or removed from, tube 22. The inner diameter of said second portion 16 of said elongated, vertically disposed first cylinder 12 is preferably somewhat constricted, as shown in FIG. 2, relative to the inner diameter of said first portion 14 of said elongated, vertically disposed first cylinder 12, so that the flow of fluid therethrough can be accelerated.

The novel apparatus herein also includes an elongated vertically disposed coaxial second cylinder 26 slidably disposed around the lower exterior portion of said elongated first cylinder 12, lying within said container 4. On the outer wall of said second cylinder 26, preferably adjacent the upper end thereof, there is provided a lug, or abutment, 28, integral therewith, and an elongated, vertically disposed stem 30, integral with said lug, extending upwardly therefrom through said opening 10 in said cap closure 6 and exteriorly of said cap closure. The upper end of said stem 30 is preferably provided with an enlarged arrow-shaped head 32 and immediately below said head a circumferentially disposed channel 34. A compression spring 36 is coiled around vertically disposed stem 30 and disposed between said lug 28 and the underside a cap closure 6 for normally maintaining said second cylinder 26 in its lowermost position.

An elongated trigger, and handle, mechanism, 38 is disposed on the upper surface of cap closure 6 comprising a first portion 40 extending across the upper surface of cap closure 6 and a second portion 42 extending outwardly and then downwardly therefrom. The first portion 40 of trigger mechanism 38, which rests on the upper surface of cap closure 6, is provided with a first opening 44 therein adjacent the free end thereof through which the upper end of elongated vertically disposed stem 30 passes upwardly therethrough, and a second opening 46, adjacent said first opening 44 but spaced away from the free end of said first portion 40 resting on the upper surface of said cap closure 6, through which said second portion 16 of said elongated first cylinder 12 passes upwardly therethrough. Trigger mechanism 38 is also provided on its underside, intermediate the ends thereof, with an enlarged portion 48, preferably integral therewith, resting on the upper surface of said cap closure 6 between said second opening 46 and the edge of the container, that serves as a fulcrum, or pivot point, for the trigger mechanism upon actuation thereof. If desired, said second portion 42 of trigger mechanism 38 can further be provided with an additional enlarged portion 50 on the underside thereof, so that when the trigger mechanism 38 is activated enlarged portion 50 will abut the adjacent wall of container 4 and will thereby limit further forward movement thereof.

Figure 3:
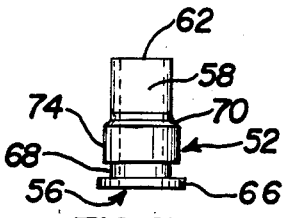
FIG. 3 is a front elevational side view of the reed valve element used in the novel apparatus herein.
Figure 4:
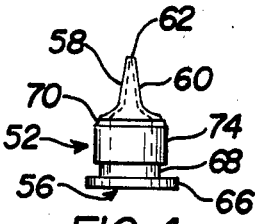
FIG. 4 is a front elevational view of the reed valve element depicted in FIG. 3 rotated 90 degrees.
Figure 5:
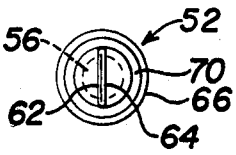
FIG. 5 is a top view of the reed valve element showing the flexible orifice located at the upper tapered edges thereof.

The novel apparatus further includes a first cylindrical reed valve 52 coaxially disposed in the lower portion of said elongated first cylinder 12 within said container and a second cylindrical reed valve 54 similarly coaxially disposed in the lower portion of said elongated second cylinder 26. The reed valves are preferably similar in configuration. One of them, reed valve 52, is further described in the preferred embodiment of FIGS. 3, 4 and 5. Reed valve 52 is cylindrical and open at the base 56 thereof and has oppositely-disposed tapered portions 58 and 60 at the upper ends thereof, forming a narrow tip 62 and a flexible orifice 64 that extends substantially the entire length of narrow tip 62. The reed valve is also provided in the preferred embodiment with a circumferential shoulder 66 and a circumferentially disposed channel 68. In order to facilitate placement of the reed valve in the two cylinders herein, the reed valve is provided with a circumferential tapered portion 70 adjacent the tapered portions 58 and 60.

The lower edges of each of the cylinders 12 and 26 are suitably adapted to retain the reed valves therein. Thus, the lower inner surface of cylinder 12 within container 4 is provided with a circumferential channel 72 therein in which the adjacent wall portion 74 of reed valve 52 will fit. Circumferential shoulder 66 will abut the lower end of first cylinder 12. The lower end of said second cylinder 26 is provided with a circumferential flange 76 extending laterally therein that fits into circumferential channel 68 of reed valve 54.

While the preferred embodiments for mounting reed valves 52 and 54 in cylinders 12 and 26, respectively, have been described and shown above, it is not the intention herein to be limited thereto, for it is obvious that modifications can be made to the lower ends of the cylinders and/or to the reed valves to provide the desired secured arrangements to each other.

The assembly, the disassembly and the operation of the novel apparatus have been greatly simplified by the design of the individual components thereof and by making some of them from suitable plastic materials. Thus the reed valves 52 and 54 can be made of natural or synthetic rubber, the container 4 of a somewhat rigid plastic, such as blow molded, high density polyethylene, the cap closure assembly 6 and the second cylinder 26 of a somewhat similar rigid plastic material, such as nylon, the spout assembly 20 of any suitable plastic material or metal and the trigger mechanism of zinc plated steel.

In assembling the device, the reed valves 52 and 54 are moved upwardly into the lower ends of the respective cylinders, with the tapered portions thereof facing upwardly, until they lock in place as shown in FIG. 2. Compression spring 36 is coiled around elongated stem 30 and cap closure assembly 6 is then mounted in association with the second cylinder 26 so that the lower end of the first cylinder 12 is longitudinally disposed in slidable relation within the upper portion of cylinder 26 and elongated stem 30 passes through opening 10 in cap closure 6. Trigger assembly 38 is then positioned downwardly in place, so that the upper end of stem 30 moves upwardly through opening 44 in the trigger assembly and is locked thereto behind enlarged head 32. Arrow-shaped head 32 will then be in firm abutting relationship with the upper surface of the trigger mechanism upon actuation thereof. At the same time second portion 16 of cylinder 12 moves upwardly through opening 46 of the trigger assembly 38, with enlarged portion 48 of the trigger mechanism resting on the upper surface of cap closure 6. The resulting assembly can then be inserted within the container and attached thereto. Finally the spout assembly is fit into place as shown. If desired the spout assembly can be attached to the assembly described above before it is placed in the container. Disassembly can obviously be easily accomplished by reversing the procedure defined above.

In the operation of the novel apparatus herein, the container 4 is filled, or substantially filled, with the fluid to be dispensed. In order to fill the container, the cap assembly is removed from the container and the cap assembly is removed from the container as a unit, the fluid is placed into the container and the cap assembly is thereafter mounted in place. The apparatus is then ready for use.

As shown in FIG. 2, the lower end of cylinder 26 will extend downwardly into the container and into the fluid disposed therein. The weight of the fluid in the container will cause it to move upwardly through the orifice of reed valve 54 and fill lower chamber 78 with fluid, or at least to the level of the fluid in the container. When it is desired to dispense fluid from the container, trigger portion 42 is moved downwardly, resulting in upper movement of cylinder 26 relative to cylinder 12. When this is done, reed valve 54 will close and reed valve 52 will open. Thus, flow of fluid from the lower part of the container through reed valve 54 into lower chamber 78 will not take place. During upward movement of cylinder 26, however, reed valve 52 will remain open and fluid will flow into upper chamber 80 and then outwardly through spout mechanism 20. When the trigger 42 is released compression spring 36 will force cylinder 26 downwardly relative to cylinder 12, resulting in a vacuum in lower chamber 78. Reed valve 52 will close, but reed valve 54 will open, again resulting in fluid moving upwardly into lower chamber 78. The aparatus is then again in position for dispensing fluid therefrom.

Obviously, many modifications and variations of the invention, as hereinabove set forth, can be made without departing from the spirit and scope thereof, and therefore, only such limitations should be imposed as are indicated in the appended claims.

What is claimed is:

1. Apparatus for dispensing fluid comprising a container, a cap closure therefor having an opening therein, an elongated, vertically disposed first cylinder integral with said cap closure having a first portion extending vertically downwardly from said cap closure into said container and a second portion extending vertically upwardly and exteriorly of said cap closure, said first cylinder closed at the upper end thereof but having an opening in a wall thereof; said cap closure and said first cylinder being a single unit; a spout assembly mounted in said opening in said wall of said upper end of said first cylinder; an elongated, vertically disposed coaxial second cylinder slidably disposed around the lower exterior portion of said first cylinder lying within said container, a lug integral with said second cylinder on the outer wall thereof, an elongated vertical stem integral with said lug extending vertically upward therefrom through said opening in said cap closure and exteriorly of said cap closure, said elongated vertical stem having an enlarged head at the upper end thereof; said second cylinder, said lug and said stem being a single unit; a compression spring coiled around said elongated vertical stem and disposed between said lug and the underside of said cap closure; an elongated trigger mechanism disposed on said cap closure having a first portion extending across the upper surface of said cap closure, provided with a first opening, through which said elongated vertical stem passes upwardly therethrough, and a second opening through which said second portion of said first cylinder passes upwardly therethrough, said trigger mechanism having a second portion thereof extending outwardly therefrom; a first cylindrical reed valve coaxially disposed in the lower portion of said elongated first cylinder; and a second reed valve coaxially disposed in the lower portion of said elongated second cylinder, each of said reed valves being open at one end and tapered on two sides thereof to its other end, thereby forming an orifice at said other end, said reed valves being disposed with said orifices facing upwardly.

2. The apparatus of claim 1, wherein the upper end of said elongated stem is provided with an enlarged arrow-shaped head thereon.

3. The apparatus of claim 1 wherein said trigger mechanism is provided on its undereside with an enlarged portion thereof resting on the upper surface of said cap closure; said enlarged portion acting as a pivot point for said trigger mechanism upon activation thereof.

4. Apparatus for dispensing fluid comprising a container, a cap closure therefor having an opening therein, an elongated, vertically disposed first cylinder integral with said cap closure having a first portion extending vertically downwardly into said container and a second portion extending vertically upwardly and exteriorly of said container, said first cylinder closed at the upper end thereof but having an opening in a wall thereof; a spout assembly mounted in said latter opening; an elongated, vertically disposed coaxial second cylinder slidably disposed around the lower exterior portion of said first cylinder lying within said container, a lug intergral with said second cylinder on the outer wall thereof, an elongated vertical stem integral with said lug extending vertically upward therefrom through said opening in said cap closure and exteriorly of said cap closure, said elongated vertical stem having an enlarged arrow-shaped head at the upper end thereof, a compression spring coiled around said elongated vertical stem and disposed between said lug and the underside of said cap closure, an elongated trigger mechanism disposed on said cap closure having a first portion extending across the upper surface of said cap closure, provided with a first opening, through which said elongated vertical stem passes upwardly therethrough, and a second opening through which said second portion of said first cylinder passes upwardly therethrough, said trigger mechanism having a second portion thereof extending outwardly therefrom, said trigger mechanism provided on its underside with an enlarged portion thereof resting on the upper surface of said cap closure, a first cylindrical reed valve coaxially disposed in the lower portion of said elongated first cylinder and a second reed valve coaxially disposed in the lower portion of said elongated said second cylinder, the lower portion of said first cylinder being provided on its inner surface with a circumferential channel and said first reed valve being provided on its outer surface with an outer wall portion adapted to fit within said channel, the lower portion of said second cylinder being provided with a circumferential flange extending laterally therein and said second reed valve being provided with a circumferential channel on its outer surface in which said flange is adapted to fit, each of said reed valves being open at one end and tapered on two sides thereof to its other end, thereby forming an orifice at said other end, said reed valves being disposed with said orifices facing upwardly.

5. Apparatus for dispensing fluid comprising a container, a cap closure therefor having an opening therein, an elongated, vertically disposed first cylinder integral with said cap closure having a first portion extending vertically downwardly into said container and a second portion extending vertically upwardly and exteriorly of said container, said first cylinder closed at the upper end thereof but having an opening in a wall thereof; a spout assembly mounted in said latter opening; an elongated, vertically disposed coaxial second cylinder slidably disposed around the lower exterior portion of said first cylinder lying within said container, a lug integral with said second cylinder on the outer wall thereof, an elongated vertical stem integral with said lug extending vertically upward therefrom through said opening in said cap closure and exteriorly of said cap closure, said elongated vertical stem having an enlarged head at the upper end thereof, a compression spring coiled around said elongated vertical stem and disposed between said lug and the underside of said cap closure, an elongated trigger mechanism disposed on said cap closure having a first portion extending across the upper surface of said cap closure, provided with a first opening, through which said elongated vertical stem passes upwardly therethrough, and a second opening through which said second portion of said first cylinder passes upwardly therethrough, said trigger mechanism having a second portion thereof extending outwardly therefrom, a first cylindrical reed valve coaxially disposed in the lower portion of said elongated first cylinder and a second reed valve coaxially disposed in the lower portion of said elongated second cylinder, each of said reed valves being open at one end and tapered on two sides thereof to its other end, thereby forming an orifice at said other end, said reed valves being disposed with said orifices facing upwardly, the lower portion of said second cylinder is provided with a circumferential flange extending laterally therein and said second reed valve is provided with a circumferential channel on its outer surface in which said flange is adapted to fit.

6. Apparatus for dispensing fluid comprising a container, a cap closure therefor having an opening therein, an elongated, vertically disposed first cylinder integral with said cap closure having a first portion extending vertically downwardly into said container and a second portion extending vertically upwardly and exteriorly of said container, said first cylinder closed at the upper end thereof but having an opening in a wall thereof; a spout assembly mounted in said latter opening; an elongated, vertically disposed coaxial second cylinder slidably disposed around the lower exterior portion of said first cylinder lying within said container, a lug integral with said second cylinder on the outer wall thereof, an elongated vertical stem integral with said lug extending vertically upward therefrom through said opening in said cap closure and exteriorly of said cap closure, said elongated vertical stem having an enlarged head at the upper end thereof, a compression spring coiled around said elongated vertical stem and disposed between said lug and the underside of said cap closure, an elongated trigger mechanism disposed on said cap closure having a first portion extending across the upper surface of said cap closure, provided with a first opening, through which said elongated vertical stem passes upwardly therethrough, and a second opening through which said second portion of said first cylinder passes upwardly therethrough, said trigger mechanism having a second portion thereof extending outwardly therefrom, a first cylindrical reed valve coaxially disposed in the lower portion of said elongated first cylinder and a second reed valve coaxially disposed in the lower portion of said elongated second cylinder, each of said reed valves being open at one end and tapered on two sides thereof to its other end, thereby forming an orifice at said other end, said reed valves being disposed with said orifices facing upwardly, the lower portion of said second cylinder is provided with a circumferential flange extending laterally therein and said second reed valve is provided with a circumferential channel on its outer surface in which said flange is adapted to fit.

* * * * *